US005480316A

United States Patent [19]

Kinross et al.

[11] Patent Number: 5,480,316

[45] Date of Patent: Jan. 2, 1996

[54] LOW INSERTION FORCE CARD EDGE CONNECTOR

[75] Inventors: Timothy J. Kinross, Greensboro; Roger L. Thrus, Clemmons, both of N.C.

[73] Assignee: The Whitaker Corporation, Wilmington, Del.

[21] Appl. No.: 264,811

[22] Filed: Jun. 23, 1994

[51] Int. Cl.[6] ..... H01R 13/62

[52] U.S. Cl. ..... 439/326; 439/636

[58] Field of Search ..... 439/326–329, 439/62, 629–637

[56] References Cited

U.S. PATENT DOCUMENTS

| | | | |
|---|---|---|---|
| 4,136,917 | 1/1979 | Then et al. | 339/17 L |
| 4,737,120 | 4/1988 | Grabbe et al. | 439/326 |
| 4,984,996 | 1/1991 | Watanabe et al. | 439/326 |
| 5,002,494 | 3/1991 | Olsson | 439/77 |
| 5,004,429 | 4/1991 | Yagi et al. | 439/326 |
| 5,013,257 | 5/1991 | Korsunsky et al. | 439/326 |
| 5,015,196 | 5/1991 | Yamada | 439/326 |
| 5,046,955 | 9/1991 | Olsson | 439/74 |
| 5,049,511 | 9/1991 | Yu | 439/325 |
| 5,057,032 | 10/1991 | Kaufman et al. | 439/326 |
| 5,061,200 | 10/1991 | Yang Lee | 439/326 |
| 5,061,201 | 10/1991 | Tuan | 439/326 |
| 5,064,381 | 11/1991 | Lin | 439/326 |
| 5,080,602 | 1/1992 | Lee Chao | 439/326 |
| 5,100,337 | 3/1992 | Lee Chao | 439/326 |
| 5,174,780 | 12/1992 | Yang Lee | 439/326 |
| 5,199,895 | 4/1993 | Chang | 439/326 |

*Primary Examiner*—Gary F. Paumen
*Assistant Examiner*—Hien D. Vu
*Attorney, Agent, or Firm*—Robert J. Kapalka

[57] ABSTRACT

A socket for electrically connecting a circuit card to a substrate comprises a dielectric housing (10) having a card receiving slot (12) and a plurality of contacts (30). Each of the contacts (30) comprises an electrically conductive body including a portion rigidly secured with respect to the housing, a lead for engaging a respective circuit trace on the substrate, and an elastic portion extending from the rigidly secured portion along a course which includes first a stress loop (44) and then a contact loop (46). The contact loop (46) is open in a direction toward the slot opening. A pair of opposed contact points (50, 52) at ends of the contact loop 46 extend into the slot (12) through opposite sides thereof for engaging respective contact pads on the circuit card. The stress loop (44) is open in a direction substantially opposite to the contact loop. The contacts are arranged such that the circuit card is insertable in the slot in a first orientation with a minimal insertion force, and the card is pivotable in a direction away from the stress loop to a second orientation, wherein the circuit card is securable by latch members and the contact points are elastically urged into engagement with their respective contact pads on the circuit card.

8 Claims, 5 Drawing Sheets

LOW INSERTION FORCE CARD EDGE CONNECTOR

FIELD OF THE INVENTION

The invention relates to a card edge connector wherein a circuit card is insertable into the connector along a plane in a first orientation and is angularly pivotable to a second orientation.

BACKGROUND OF THE INVENTION

Low insertion force card edge connectors are known wherein a circuit card which is inserted into the connector with a straight line motion at a first angular orientation experiences minimal insertion resistance. The card is then pivotable to a second angular orientation wherein contact pads on the circuit card engage contacts in the connector and deflect the contacts so as to create a normal force between each contact and its associated contact pad. The card is secured in the second orientation by latch members.

U.S. Pat. No. 4,737,120 discloses a low insertion force card edge connector having contacts with first and second contact portions extending from a base. The first and second contact portions are independently pivotable about their junctions with the base, and each of the contact portions has a projection which engages a respective contact pad on the circuit card. A problem with these contacts arises when the circuit card is bent or warped out of its plane. In that case one or more of the contact portions may not be deflected enough to create a normal force sufficient to ensure a good electrical connection with its associated contact pad.

In order to provide a greater tolerance for circuit cards of different thickness and for cards that are bent or warped out of their plane, contacts have been configured with opposed contact projections disposed on a continuous member which is pivotably connected to the base at a single pivot point. U.S. Pat. No. 4,984,996 discloses such a contact having an upstanding spring arm (25) extending from a base (24) upwardly to a connection beam and extending through a reverse loop to a C-shaped section (26). First and second contact points (**25*a*, 26*a*) are defined at opposite ends of the C-shaped section. This contact is forgiving of circuit card dimensional variations because both of the first and second contact points (25*a*, 26*a*) can pivot with the C-shaped section (26) as an integral unit about the pivotal connection of the spring arm (25) with the base. Accordingly, the spring arm (25) must have a clearance on either side to permit pivoting, and this clearance adds to the overall dimensions of the connector. It should be noted that during insertion of the circuit card in this connector, the circuit card is pivoted toward the attached end of the C-shaped section, i.e., toward the reverse loop and toward the spring arm. Pivoting the card in this direction causes the reverse loop to be put in tension as the card acts on the contact point (26*a*), and the connection beam between the reverse loop and the spring arm (25**) to be put in compression.

A similar contact is disclosed in U.S. Pat. No. 5,080,602. Here, the contact includes a spring arm (24) extending upwardly from a pivot portion (23) to a connection beam and extending through a reverse loop downwardly to a C-shaped section which has contact points (25, 27) at opposite ends. Again, the card is pivoted toward the reverse loop and the spring arm, thereby tensioning the reverse loop and compressing the connection beam, and clearance must be provided for the spring arm (24) to flex about the pivot portion (23).

The present invention provides a low insertion force connector having contacts which do not rely on a spring arm to supply normal force to the circuit card. Instead, the card is pivoted in a direction away from the stress loop, and a reaction force of the contact loop puts the reverse loop in compression, thereby generating a normal force on the card.

SUMMARY OF THE INVENTION

It is an object of the invention to improve the stress distribution on contacts in a card edge connector.

It is another object of the invention to increase the mechanical efficiency of contacts in a card edge connector.

It is a further object of the invention to reduce the size of contacts in a card edge connector.

These and other objects are accomplished by a socket for electrically connecting a circuit card to a substrate wherein a dielectric housing defines a slot having opposite side surfaces and an opening to an exterior of the housing for receiving an edge portion of the circuit card. The housing further has a plurality of cavities communicating with the slot through the side surfaces thereof. Latch members on the housing at opposite ends of the slot enable the circuit card to be releasably secured to the housing. A plurality of contacts are disposed in respective ones of the cavities. Each of the contacts comprises an electrically conductive body including a portion rigidly secured with respect to the housing, a lead extending from the rigidly secured portion outwardly of the housing for engaging a respective circuit trace on the substrate, and an elastic portion extending from the rigidly secured portion along a course which includes first a stress loop and then a contact loop. The contact loop is open toward the slot opening and has a pair of opposed contact points which extend into the slot through the opposite side surfaces for engaging respective contact pads on the circuit card. The stress loop is open in a direction substantially opposite to the contact loop. The contacts are arranged such that the circuit card is insertable in the slot in a first orientation with a minimal insertion force, and the card is pivotable in a direction away from the stress loop to a second orientation, wherein the circuit card is securable by the latch members and the contact points are elastically urged into engagement with their respective contact pads.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENT

Figure 1:
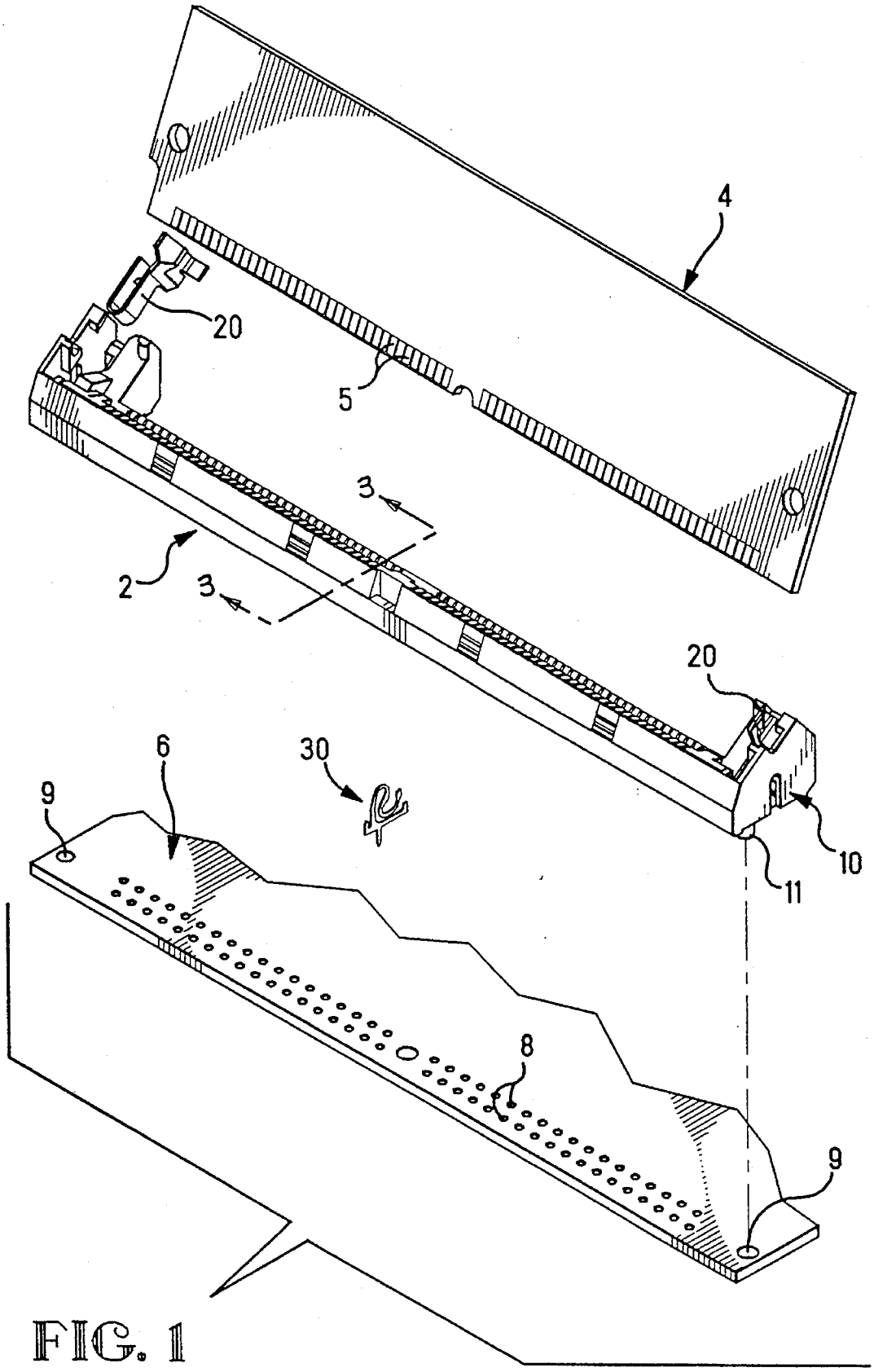
FIG. 1 is an exploded isometric view of a socket, a circuit card and a substrate.

There is shown in FIG. 1 a socket 2 according to the invention for interconnecting a circuit card 4 to a substrate 6. A plurality of contact pads 5 are aligned in a row along an edge on one side of the circuit card. Each of the pads 5 is paired with a complementary pad in a matching row of contact pads on the other side of the card, and each pair of pads is electrically coupled to a single circuit trace (not shown) on the card so as to provide redundant electrical contact pads for each of the circuit traces. The socket 2 electrically connects the contact pads 5 with respective circuit traces (not shown) on the substrate 6, the circuit traces on the substrate typically terminating in plated through holes 8 or surface mount contact pads (not shown).

Figure 2:
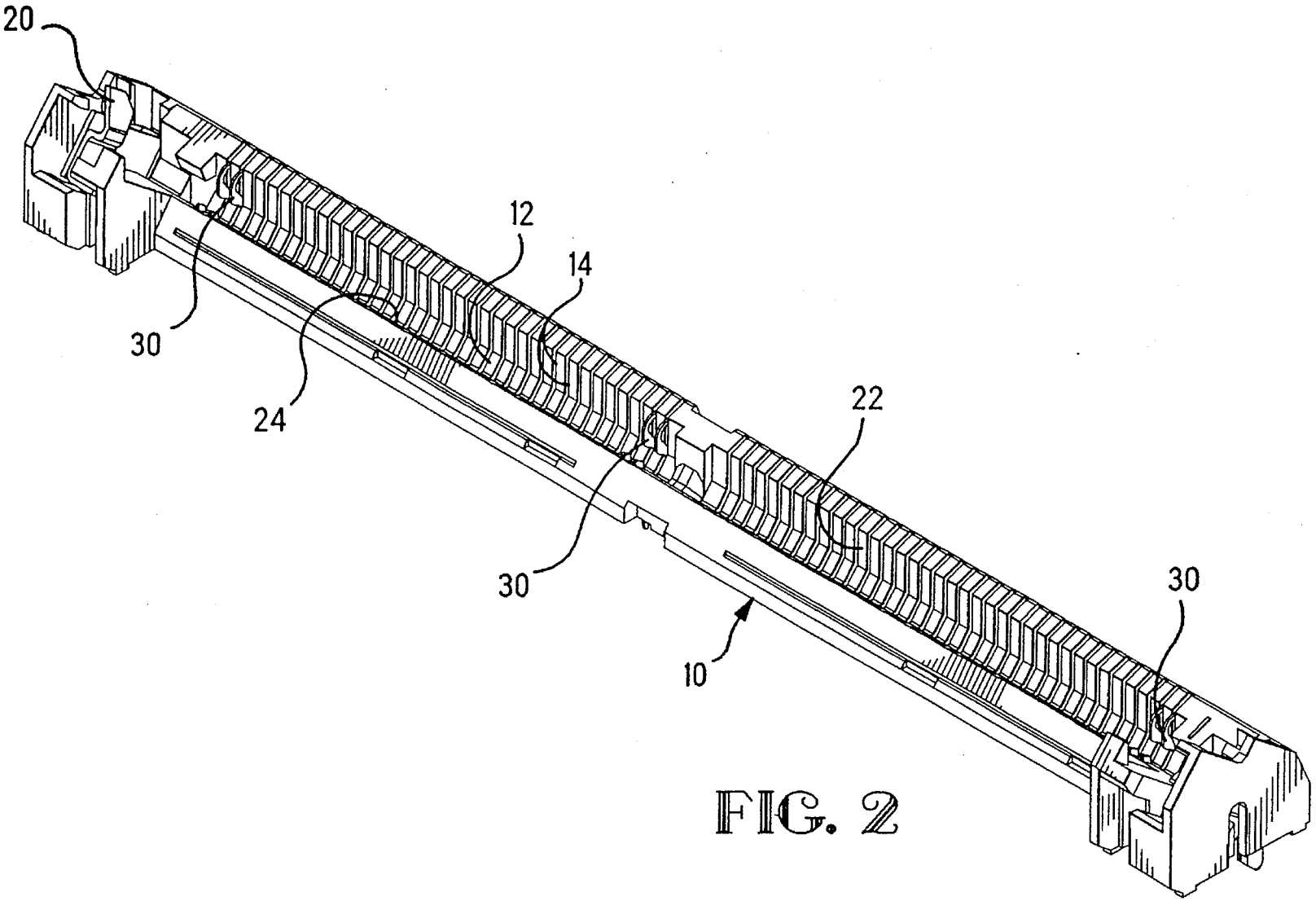
FIG. 2 is an isometric view of the socket from a different direction.
Figure 3:
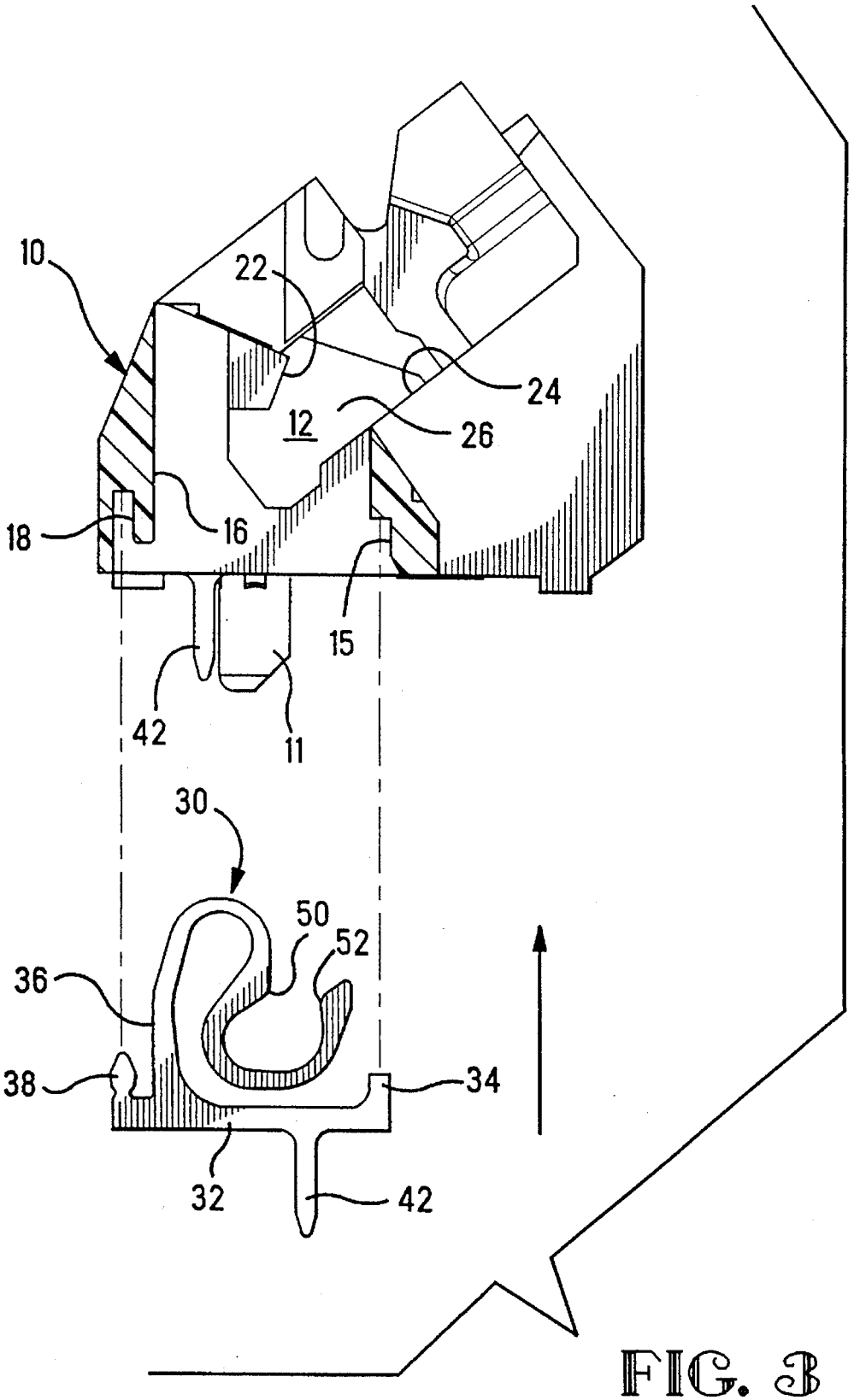
FIG. 3 is a cross-sectional view of the socket with a contact exploded away, taken along line 3—3 of FIG. 1.

As shown in FIGS. 1–3, the socket 2 comprises a dielectric housing 10 defining a slot 12 and a plurality of cavities 14. The slot 12 has side surfaces 22, 24 through which the cavities 14 have openings to the slot 12, and the slot 12 has an upward opening 26 through which the edge portion of the circuit card 4 can be inserted. The cavities 14 have openings through a bottom of the housing, and a contact 30 is insertable in each of the cavities through its bottom opening. Locating posts 11 on the housing are receivable in complementary-shaped holes 9 in the substrate for positioning purposes.

Figure 4:
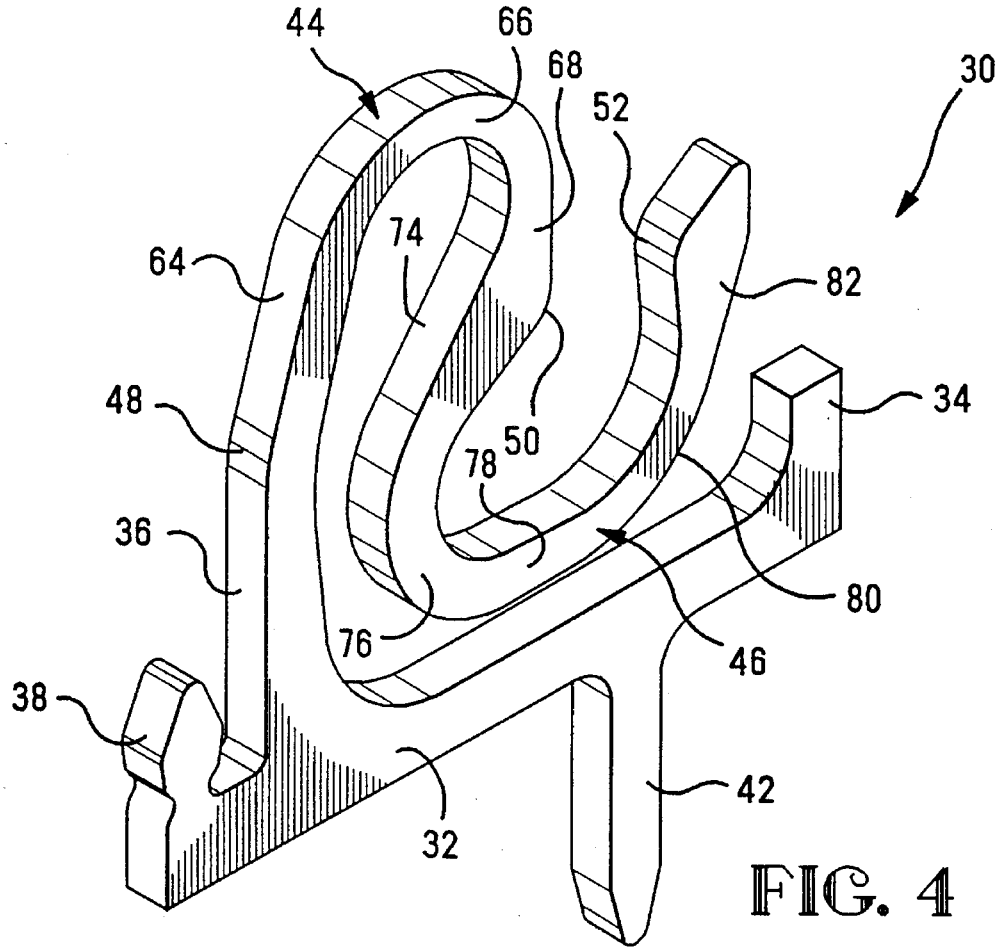
FIG. 4 is an isometric view of a contact used in the socket.

Referring to FIGS. 3 and 4, each of the contacts 30 comprises an electrically conductive body having a portion which is rigidly secured with respect to the housing, the rigidly secured portion including a base 32, a first abutment 34, a second abutment 36 and a barb member 38. The first and second abutments 34, 36 fit snugly between opposite end walls 15, 16 of the cavity 14, thereby making an interference fit of the contact 30 in the housing. Additionally, the barb member 38 engages in sidewalls of a hole 18 in the housing to prevent pullout of the contact 30 from the socket. A lead such as through hole lead 42 extends from the base 32 for engaging a circuit trace on the substrate 6.

Figure 6:
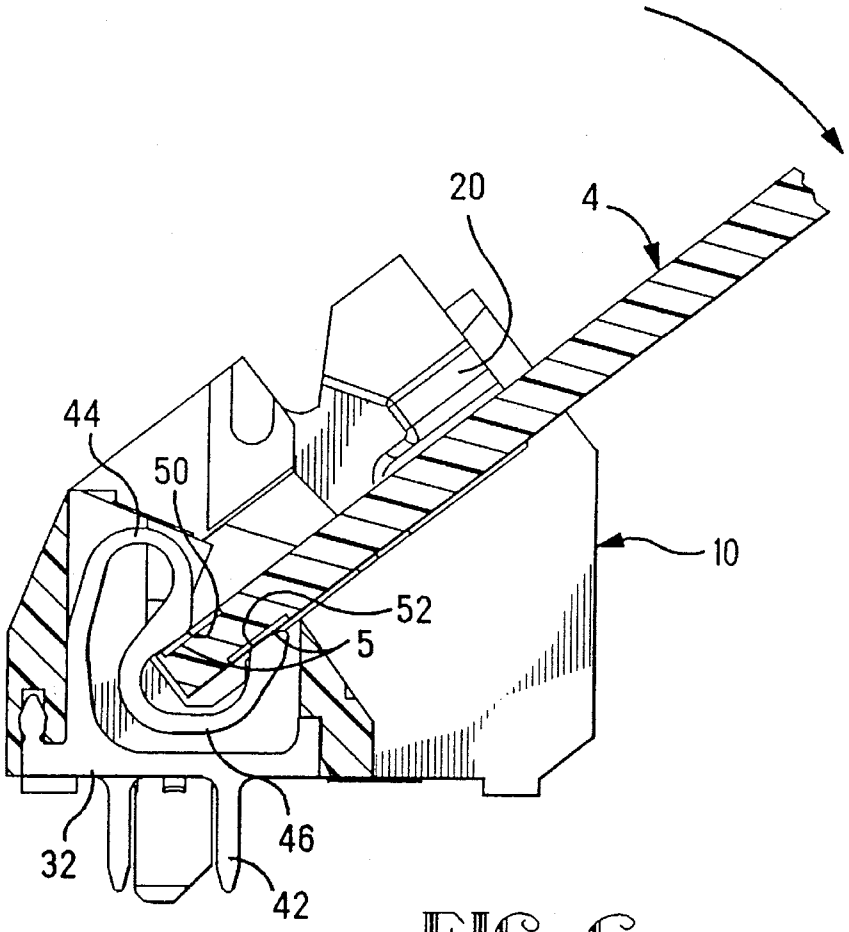
FIG. 6 is a cross-sectional view through the socket showing the circuit card having been pivoted to a second orientation.

The contact 30 further includes an elastic portion which extends from the rigidly secured portion along a course which includes first a stress loop 44 and then a contact loop 46. The stress loop 44 originates at a pivotal connection 48 with the second abutment 36 and extends along a stress loop first leg 64, through a flexible reverse loop 66, and along a stress loop second leg 68 until it joins with the contact loop 46 in the vicinity of a contact point for the circuit card 4. The contact loop 46 is open toward the slot opening 26 when the contact 30 is disposed in the socket so that the edge portion of the circuit card 4 may be received within the contact loop. The stress loop 44 is open in a direction substantially opposite to the opening of the contact loop 46. The contact loop 46 extends along a contact loop first leg 74, a first flex portion 76, a connector beam 78, a second flex portion 80, and a contact loop second leg 82 to a free end. The contact loop 46 has first and second contact points 50, 52 which oppose each other from ends of the contact loop first and second legs 74, 82, respectively. The contact points 50, 52 extend into the slot 12 through the opposite side surfaces 22, 24, respectively, for engaging respective contact pads 5 on the circuit card 4, as shown in FIG. 6. The first contact point 50 is disposed proximate a junction of the stress loop second leg 68 and the contact loop first leg 74. This location of the first contact point 50 approximately midway between the flexible reverse loop 66 and the first flex portion 76 provides good stress distribution in both the stress loop 44 and the contact loop 46 when the card 4 is installed in the socket.

Figure 5:
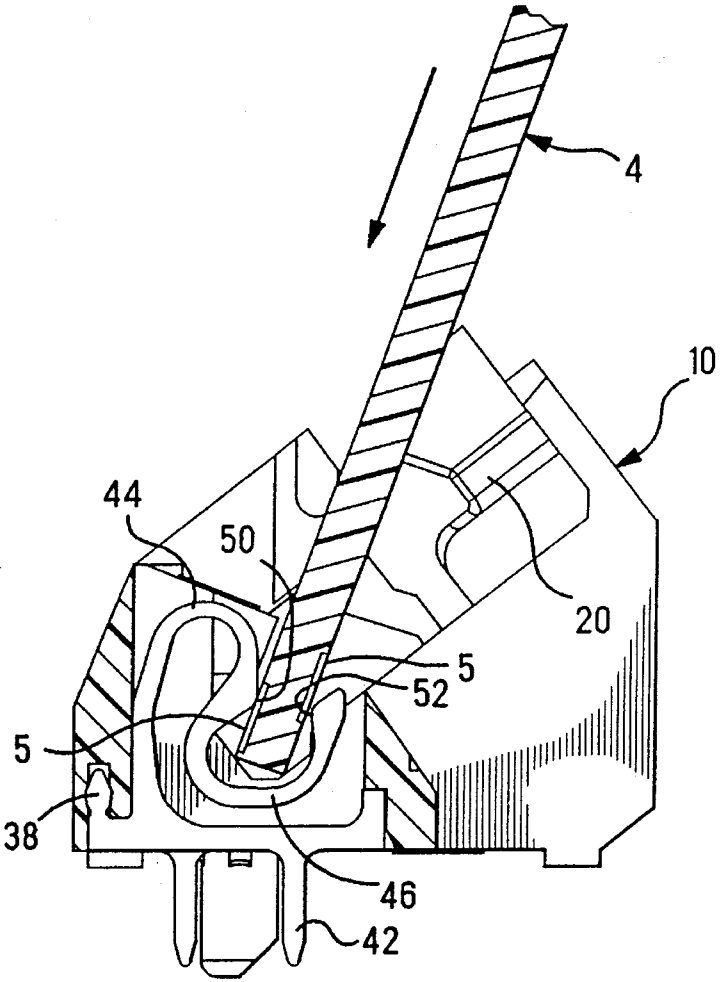
FIG. 5 is a cross-sectional view through the socket showing a circuit card being inserted in a first orientation.

The circuit card is inserted into the socket with a two-part motion. As shown in FIG. 5, the card 4 is initially inserted linearly at a first orientation which permits the card to enter the slot without displacing the contact points 50, 52. Once the card edge portion is within the slot, the card is pivoted in a direction away from the stress loop 44 to a second orientation, thereby applying pressure to the ends of the contact loop so as to displace the ends further apart. Displacement of the ends results in reaction forces which urge the contact points 50, 52 into engagement with their respective contact pads 5. Further, pivoting of the card causes compression of the stress loop 44 due to a force being applied to the first contact point 50.

The housing 10 has latch members 20 at opposite ends of the slot 12 to secure the circuit card 6 in the socket after pivoting the card to the second orientation. The latch members 20 are preferably insertable latch members as disclosed in U.S. Pat. No. 4,986,765 which is incorporated by reference as if set forth fully herein. In FIG. 1, one of the insertable latch members 20 is shown exploded away from the socket for clarity.

Figure 7:
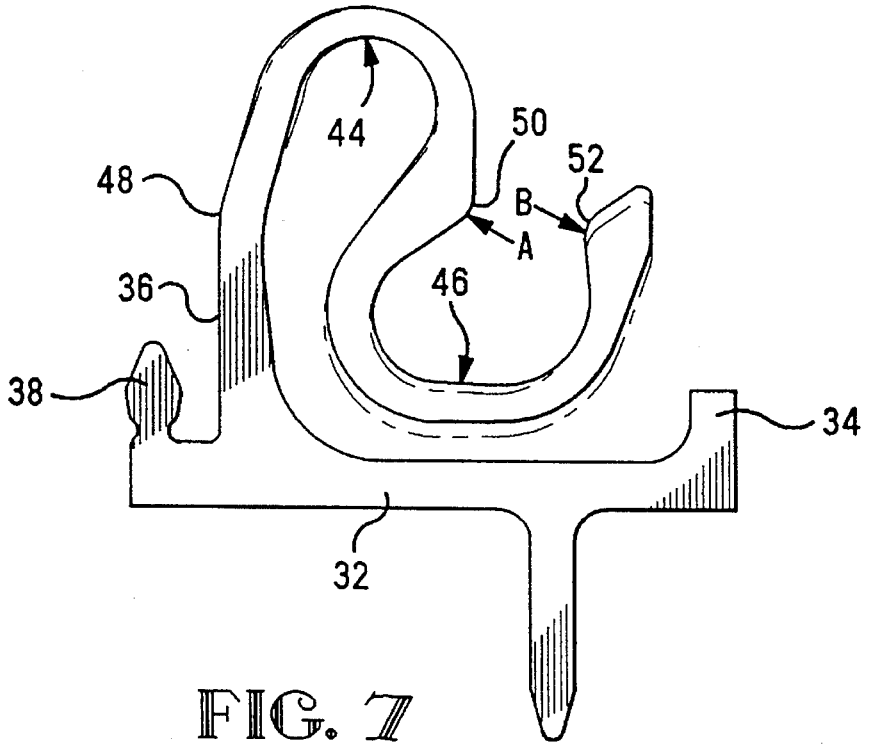
FIG. 7 is a plan view of a contact showing normal and deflected configurations.

FIG. 7 illustrates deflection of the contact 30 when a circuit card is inserted in the socket, an unstressed contact being shown in solid lines and a deflected contact being shown in phantom. All forces applied by the circuit card on the contact are applied through the contact points 50, 52. Deflection of the contact results in pivoting of the elastic portion in a clockwise direction about the pivotal connection 48. However, the stress loop 44 is displaced only marginally and is actually in compression due to a force being applied in direction A through the contact point 50. In contrast, the contact loop 46 is displaced a relatively greater amount due to the combined effects of forces applied in directions A and B through the contact points 50 and 52, respectively. Thus, the contact loop 46 can "float" as required to accommodate a circuit card which may be warped or bent out of its plane. The contact loop 46 is in tension due to the gap between the contact points 50, 52 being expanded.

The invention has been illustrated in one embodiment comprising a 40° Single In-line Memory Module (SIMM) socket, i.e., a SIMM socket wherein the module board resides at a 40° angle with respect to the mother board. This embodiment is presently preferred because it permits a plurality of modules to be socketed on a relatively small area of mother board while maintaining a relatively low overall profile. However, the invention may be incorporated in other styles of card edge connectors having circuit cards disposed at angles other than 40°, and all such configurations are considered to be within the scope of the invention.

The invention has the advantages of providing a low insertion force socket having a low overall profile. Contacts in the socket have a simple and reliable design which provides better distribution of stresses and more efficient operating characteristics than the prior art contacts.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A socket for electrically connecting a circuit card to a substrate, comprising:

a dielectric housing which defines a slot having opposite side surfaces and an opening to an exterior of the housing for receiving an edge portion of the circuit card therein, and a plurality of cavities communicating with the slot through the side surfaces thereof;

latch members on the housing at opposite ends of the slot for releasably securing the circuit card to the socket; and, a plurality of contacts disposed in respective ones of the cavities, each of the contacts comprising an electrically conductive body including a portion rigidly secured with respect to the housing, a lead extending from the rigidly secured portion outwardly of the housing for engaging a respective circuit trace on the substrate, and an elastic portion extending from the rigidly secured portion along a course which includes first a stress loop and then a contact loop, the contact loop being open toward the slot opening and having a pair of opposed contact points which extend into the slot through the opposite side surfaces for engaging respective contact pads on the circuit card, a first one of the contact points being disposed proximate a junction of the stress loop and the contact loop, the stress loop being open in a direction substantially opposite to the contact loop, the contacts being arranged such that the circuit card is insertable in the slot in a first orientation with a minimal insertion force, and the portion of the circuit card outside of said slot is pivotable in a direction away from the stress loop to a second orientation, wherein the circuit card is securable by the latch members and the contact points are elastically urged into engagement with their respective contact pads.

2. The socket according to claim 1, wherein each of the contacts is insertable into the housing through a bottom opening of its respective said cavity.

3. The socket according to claim 2, wherein each of the contacts is received in an interference fit between opposite end walls of its respective said cavity.

4. The socket according to claim 1, wherein the stress loop is compressed and the contact loop is tensioned when the circuit card is secured in the socket.

5. The socket according to claim 1, wherein the first one of the contact points is disposed approximately midway between flexible portions of the stress loop and the contact loop.

6. A socket for electrically connecting a circuit card to a substrate, comprising:

a dielectric housing which defines a card receiving slot;

a plurality of contacts disposed in the housing, each of the contacts comprising an electrically conductive body including a portion rigidly secured with respect to the housing, a lead extending outwardly of the housing for engaging a respective circuit trace on the substrate, and an elastic portion extending from the rigidly secured portion along a course which includes first a stress loop and then a contact loop, the contact loop being open toward the slot and having a pair of opposed contact points which extend into the slot through opposite sides thereof for engaging respective contact pads on the circuit card, a first one of the contact points being disposed proximate a junction of the stress loop and the contact loop, the stress loop being open in a direction substantially opposite to the contact loop, the contacts being arranged to permit insertion of the circuit card in a first orientation with a minimal insertion force, the contacts permitting pivoting of the portion of the circuit card outside of said slot in a direction away from the stress loop to a second orientation, wherein the contact points are elastically urged into engagement with their respective contact pads; and, latch members on the housing for releasably securing the circuit card to the socket.

7. The socket according to claim 6, wherein the stress loop is compressed and the contact loop is tensioned when the circuit card is secured in the socket.

8. The socket according to claim 6, wherein the first one of the contact points is disposed approximately midway between flexible portions of the stress loop and the contact loop.

* * * * *